US006659635B2

(12) United States Patent
Ekholm

(10) Patent No.: US 6,659,635 B2
(45) Date of Patent: Dec. 9, 2003

(54) METHOD FOR INTRODUCING A FIRST FLUID INTO A SECOND FLUID, PREFERABLY INTRODUCTION OF STEAM INTO FLOWING CELLULOSE PULP

(75) Inventor: Rolf Ekholm, Karlstad (SE)

(73) Assignee: Kvaerner Pulping AB, Karlstad (SE)

( * ) Notice: Subject to any disclaimer, the term of this patent is extended or adjusted under 35 U.S.C. 154(b) by 0 days.

(21) Appl. No.: 10/299,771

(22) Filed: Nov. 18, 2002

(65) Prior Publication Data

US 2003/0147301 A1 Aug. 7, 2003

Related U.S. Application Data

(62) Division of application No. 09/890,022, filed as application No. PCT/SE00/00137 on Jan. 24, 2000, now abandoned.

(30) Foreign Application Priority Data

Jan. 26, 1999 (SE) ..... 9900221

(51) Int. Cl.[7] ..... B01F 5/06

(52) U.S. Cl. ..... 366/160.1; 366/167.1; 366/176.2

(58) Field of Search ..... 366/151.1, 152.1, 366/160.1, 162.1, 167.1, 173.1, 173.2, 174.1, 176.1, 176.2, 181.5, 336, 338, 340; 162/57, 243

(56) References Cited

U.S. PATENT DOCUMENTS

| | | | | |
|---|---|---|---|---|
| 45,369 | A | * | 12/1864 | Maitland |
| 1,140,548 | A | * | 5/1915 | Vogelsang |
| 1,496,345 | A | * | 6/1924 | Lichtenthaeler |
| 1,519,371 | A | * | 12/1924 | Farnsworth |
| 1,702,373 | A | * | 2/1929 | Alexander |
| 1,826,776 | A | * | 10/1931 | Gunther |
| 1,848,122 | A | * | 3/1932 | Forster |
| 1,992,581 | A | * | 2/1935 | Reeder |
| 2,429,297 | A | * | 10/1947 | Rudolph |

(List continued on next page.)

FOREIGN PATENT DOCUMENTS

| | | | | |
|---|---|---|---|---|
| DE | 3325969 | * | 1/1985 | |
| FI | 92417 | * | 7/1994 | |
| JP | 2000-213681 | * | 8/2000 | ..... 366/167.1 |

*Primary Examiner*—Charles E. Cooley
(74) *Attorney, Agent, or Firm*—Rolf Fasth; Fasth Law Offices

(57) ABSTRACT

The apparatus is adapted for the admixing of a first fluid, preferably steam into the flow of a second fluid, preferably cellulose pulp. With the purpose of obtaining a high and good admixing capacity and avoiding the generation of noise, the admixing of the second fluid is effected in the end of a pipe, which pipe has an increase in area of at least 50%, directly after the admixing, viewed in the direction of flow of the second fluid.

7 Claims, 2 Drawing Sheets

U.S. PATENT DOCUMENTS 2,516,684 A * 7/1950 Doull et al.
2,563,002 A * 8/1951 Bissell et al.
2,740,616 A * 4/1956 Walden
2,747,844 A * 5/1956 Slayter
2,777,467 A * 1/1957 Powell et al.
2,784,948 A * 3/1957 Pahl et al.
2,951,061 A * 8/1960 Gomory
3,147,717 A * 9/1964 Smith
3,167,305 A * 1/1965 Backx et al.
3,190,618 A * 6/1965 Katzen
3,208,829 A * 9/1965 Terenzi
3,219,483 A * 11/1965 Goos et al.
3,266,437 A * 8/1966 Blackmore et al.
3,307,567 A * 3/1967 Gogarty et al.
3,332,442 A * 7/1967 Reed
3,409,274 A * 11/1968 Lawton
3,475,508 A * 10/1969 King
3,698,430 A * 10/1972 Van Gasselt et al.
3,712,341 A * 1/1973 Constantin et al.
3,734,111 A * 5/1973 McClintock
3,818,938 A * 6/1974 Carson
3,866,886 A * 2/1975 Thorne et al.
4,043,539 A * 8/1977 Gilmer et al.
4,053,142 A * 10/1977 Johannes
4,123,800 A * 10/1978 Mazzei
4,189,243 A * 2/1980 Black
4,398,827 A * 8/1983 Dietrich
4,416,610 A * 11/1983 Gallagher, Jr.
4,474,477 A * 10/1984 Smith et al.
4,761,077 A * 8/1988 Werner
4,789,244 A * 12/1988 Dunton et al.
4,954,147 A * 9/1990 Galgon
5,004,484 A * 4/1991 Stirling et al.
5,131,757 A * 7/1992 Smith
5,333,952 A * 8/1994 Perdue
5,338,113 A * 8/1994 Fissenko
5,366,288 A * 11/1994 Dahllof et al.
5,425,581 A * 6/1995 Palm
5,452,955 A * 9/1995 Lundstrom
5,492,404 A * 2/1996 Smith
5,556,200 A * 9/1996 Ekholm et al.
5,597,236 A * 1/1997 Fasano
5,743,637 A * 4/1998 Ogier
5,793,831 A * 8/1998 Tsiklauri et al.
6,170,978 B1 * 1/2001 Short
6,341,888 B1 * 1/2002 Ekholm et al.
6,347,883 B1 * 2/2002 Ekholm
6,443,609 B2 * 9/2002 Short
6,453,926 B1 * 9/2002 Baker

* cited by examiner

METHOD FOR INTRODUCING A FIRST FLUID INTO A SECOND FLUID, PREFERABLY INTRODUCTION OF STEAM INTO FLOWING CELLULOSE PULP

PRIOR APPLICATIONS

This is a divisional patent application of U.S. patent application Ser. No. 09/890,022, filed Jul. 23, 2001 (now abandoned) that claims priority from PCT/SE00/00137, filed Jan. 24, 2000, that claims priority from Swedish Patent Application No. 9900221-4, filed Jan. 26, 1999.

TECHNICAL FIELD

The invention concerns an apparatus for introducing a first fluid into a second fluid which is flowing in a pipe, which apparatus consists of a pipe-shaped body with a through-flow channel for the said second fluid of essentially constant cross-sectional area, one or more chambers which extend round at least the majority of the circumference of the through-flow channel along at least a part of its longitudinal extent, a connection for supplying the first fluid to the said chambers from a pressure source, in which a series of through-holes is arranged in the said pipe-shaped body in the region of the said one or more chambers, through which holes the first fluid can be directed into the second fluid which is flowing through the said through-flow channel under the influence of the difference in pressure between the said chambers and the said through-flow channel.

The invention is advantageously applied to the admixing of steam into a flow of cellulose pulp.

BACKGROUND OF THE INVENTION

Apparatuses of the type mentioned above are known, see for example SE 468 341 and SE 502 393. The apparatus described in SE 502 393 is used primarily as a mixer in the bleaching departments in the cellulose factories for the admixing of steam into a pulp suspension in order to raise its temperature to a level which is required to ensure that a specific reaction takes place with the desired speed in a subsequent bleaching step. The apparatus can give good admixing of steam into the suspension, but it is difficult to control the quantity of steam needed for temperature control without reducing the effectiveness of the admixing at the same time. The steam admixing is regulated conventionally by means of a valve in the steam pipe to the said chamber. However, as the steam supply is throttled to reduce the steam introduction, the pressure in the chamber also falls and hence also the pressure difference between the inside of the chamber and the pulp suspension in the pipe. This implies, in turn, a reduction in the speed of the steam, as it enters the pulp through-flow pipe, and thereby also the penetration of the steam into the pulp suspension.

A characterizing feature of SE 468 341 is that the through-flow pipe is made as a narrow, ring-shaped passage for the second fluid, which is considered to promote a good admixing effect. However, without taking a position on whether this idea is correct or not, or whether the possibility only applies under certain conditions, it can be observed in practice that the construction entails certain problems. This is probably due to the fact that the first fluid, when it is injected at high speed into the second fluid flowing through the narrow space, interacts with the constricting body installed in the through-flow channel and that, probably due to resonance phenomena, serious vibration can occur in the apparatus.

Moreover, another disadvantage with existing apparatuses is that an uneven temperature distribution in the pulp suspension after steam injection can arise. Sometimes temperature variations of about 10° C. have been recorded between the upper and lower points in a cross section of the downstream pipe. Large temperature differences are obviously a major disadvantage when working with bleaching chemicals which are often very temperature sensitive, as for example hydrogen peroxide. Further, apparatuses of the existing type are relatively heavy. Since the material normal used is high-quality stainless steel, and, in addition, as the apparatus is relatively difficult to manufacture, the total cost for the apparatus is correspondingly high.

BRIEF ACCOUNT OF THE INVENTION

The purpose of the invention is to provide an apparatus that is not burdened with the limitations or disadvantages mentioned above. One object of the present invention is to provide an apparatus that gives good admixing of the first medium into the second medium and to ensure that good heat distribution is obtained in the downstream pipe, i.e. that very small temperature of differences are obtained in an arbitrarily chosen cross section of the downstream pipe.

Another positive effect of the apparatus is the generation of relatively little vibrations and provision of a good facility for adjustable and controllable admixing of a first medium into a second medium.

Further characteristics, aspects and advantages of the invention are presented in the following description of a preferred embodiment.

BRIEF DESCRIPTION OF THE FIGURES

In the following description of a preferred embodiment reference is made to the appended drawings, in which.

DESCRIPTION OF THE PREFERRED EMBODIMENT

The apparatus, which shall be described in the following, is developed and designed to be used for the admixing of steam into a suspension of cellulose fibres (pulp) in a pipe conveying the pulp into a cellulose factory bleaching department in order to preheat the pulp to a specified temperature suitable for a subsequent bleaching stage. However, the principle of the invention can be used also for equipment for the admixing of fluids other than steam into a second fluid, e.g. admixing of gases, such as oxygen, chlorine gas and possibly also ozone, or for admixing of a liquid, such as e.g. a pH adjusting liquid, chlorine dioxide or other treatment liquid or diluting liquid into the said second fluid, which need not necessarily be a pulp suspension.

Figure 1:
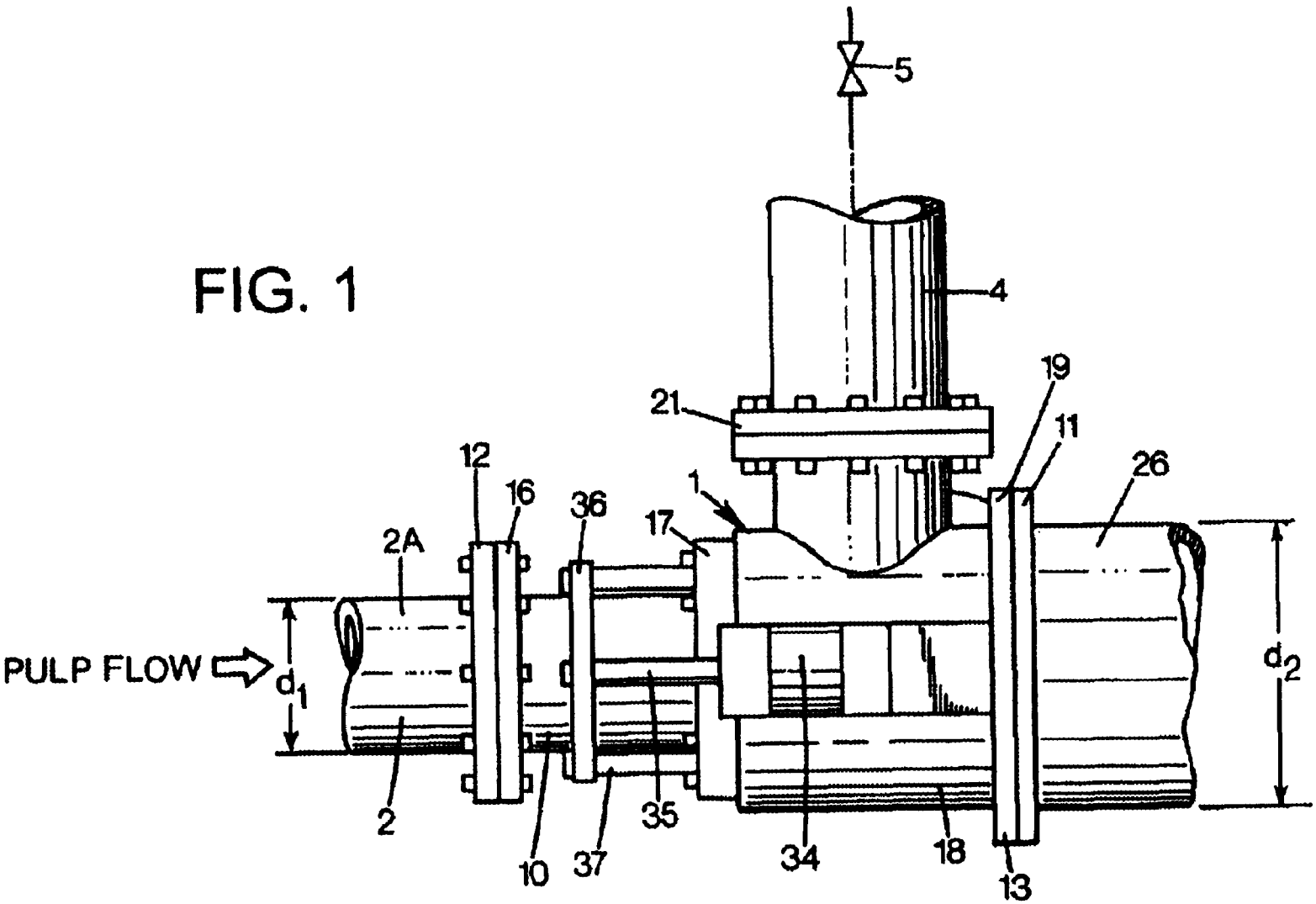
FIG. 1 is a side view of the apparatus according to the invention mounted in a pipe, and FIG. 2. shows selected parts of a side view of the apparatus, partly in cross section and with certain parts omitted.

Referring firstly to FIG. 1, an apparatus according to the invention is labelled generally with the number 1. This is arranged in a pipe 2 for a pulp suspension, which, in the example as shall be described here, has a fibre content of medium consistency, MC i.e. a dry substance content of 5–20%, preferably 8–16%. The conveying pipe 2 extends from an MC pump (not shown) to a treatment vessel (not shown) in a bleaching department. The example shows a peroxide step. The task to be carried out by means of the apparatus 1 is to preheat the pulp suspension by means of steam in the conveying pipe 2 to a temperature suitable for the bleaching process, for example about 100° C. The flow rate of the pulp in the pipe 2 is about 5–15 m/s. A steam injection pipe labelled 4 brings steam under pressure from a pressure source (not shown) into the apparatus 1. There is a throttle valve 5 in pipe 4.

A central, first element in the apparatus is labelled 10. This first element 10 consists of a circular cylindrical, pipe-shaped part referred to as pipe body in the following. The pipe body has the same internal diameter as the upstream pipe 2A to which the pipe body is joined. The inside of the pipe body, defined by the inner walls, forms a through-flow channel for the pulp which is being conveyed in the pipe 2. For installing the apparatus 1 in pipe 2 a first flange 11, and a second flange 12 are provided respectively. The first flange butts against a downstream wall 13 of a chamber 14 for the steam, which chamber is described in more detail in the following. The other flange 12 butts against flange 16 which is located in the upstream end of the pipe body 10. Flange 11 and wall 13, as well as flange 12 and flange 16 respectively are joined to each other with bolts in the conventional way.

Figure 2:
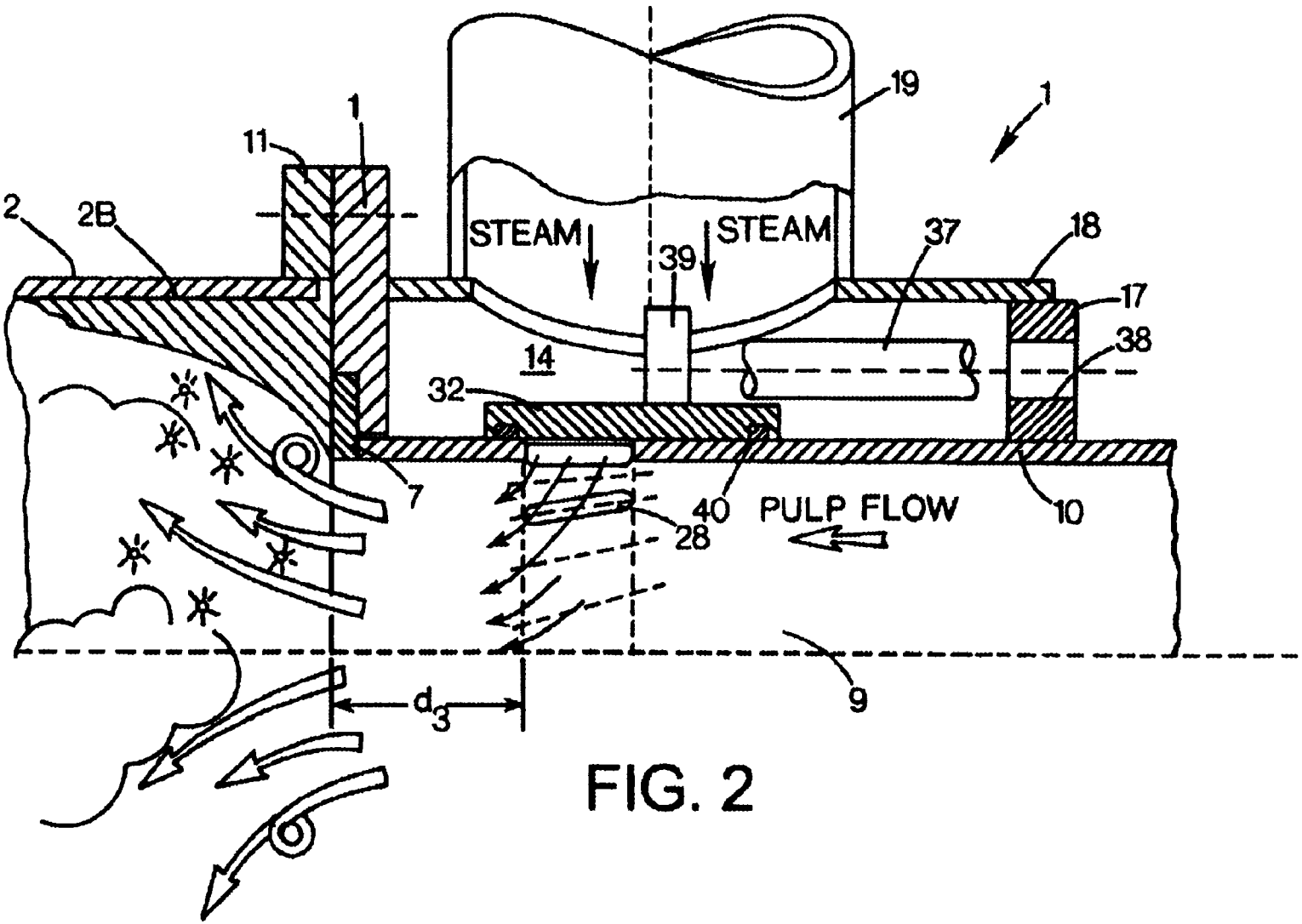

FIG. 2 shows that the chamber 14 extends round the rear and central parts of the pipe body 10. It is formed by the rear back end wall 13, a front, ring-shaped end wall 17 and a cylindrical casing 18. The front end wall 17 is joined to both the cylindrical casing 18 and the pipe body 10 by welding. Together the back wall 13, the front wall 17 and the cylindrical casing 18 form a housing, which encloses the surrounded chamber 14. A connection stud to the chamber 14 is labelled 19. The steam pipe 4 is connected to the stud 19, and hence to the chamber 14, via a flanged joint, generally labelled 21.

In the present example, the pipe body 10 has an inner diameter of, for example, 100 mm. In the region of the rear part of the chamber 14, the pipe body 10 has slits 28 which extend through the wall of the pipe body 10 and which are evenly distributed round the circumference of pipe body 10. In the example described, each slit has a length of about 10–50 mm and a width of about 4–12 mm. The distance between each slit is about 5 mm. Further, the slits are formed obliquely so that they form an acute angle of about 30° with the direction of the pulp flow.

A sleeve-shaped screen 32 bears against the pipe body 10 with a good fit. The screen 32 can be displaced from a forward position, where the whole area of each slit is exposed, and forms an open passage between the chamber 14 and the inside of the pipe body 10, to a backward position, as shown in FIG. 2, in which position the slits 28 are covered by screen 32. However, the screen 32 can be moved also to a position between the completely forward position and the completely backward position to expose a desired area of each slit 28.

In order to effect the movement of screen 32, there is a movement member, preferably a pneumatic cylinder 34 outside the apparatus 1. The cylinder has a piston rod 35. This is connected via a yoke 36 to two rods 37, which extend through the end wall 17 into the chamber 14 where they are joined to the screen 32 as indicated in FIG. 2. Sealing rings 38 are located in grooves in the bores through the end wall 17 and are made to have a tight fit around the rods 37.

The movements of the piston in the pneumatic cylinder 34 and its positioning in the cylinder are suitably regulated in the manner described in our application 9703732-9, i.e. depending on the temperature which is measured in the pipe 2 downstream of apparatus 1, the measured value is sent to an IP transducer in order to adjust, in a known way, the positioning of the piston and piston rod 35 for regulation of the quantity of steam admixed, so that the temperature is maintained at a set desired value. Normally medium pressure steam is used which is available at about 12 bar. Nevertheless, the use of high-pressure steam at 17–18 bar, and, in certain cases, also low-pressure steam can be envisaged. It is essential though to ensure that there is a pressure difference of at least 0.5 bar between the pressure in the chamber 14 and that in the pipe 2, and hence also in the pipe body 10. This pressure difference, in combination with the positioning of the screen 32, depending in turn on the desired steam flow, makes the steam flow through the holes 28 at very high speed. This ensures that the steam penetrates deeply into the pulp suspension which flows through the through-flow channel 9 in pipe body 10, so that an effective admixing of the steam into the pulp and hence good heat transfer, or as appropriate good admixing of other gases or fluids, is achieved. The steam has a speed of over 100 m/s and is normally up to or over 200 m/s.

Irrespective of the position of screen 32, the steam is injected into the pulp with a speed which is optimally high considering the pressure difference available between the available steam pressure and the pressure in the through-flow channel 9.

Further, it is shown that downstream pipe 2B has a significantly larger diameter (d2) than the upstream pipe 2A. The increase in area relative to the through-flow channel 9 should be at least about 50%. As seen is FIG. 2, the increase in area can advantageously be about 400%. (Note that FIG. 2 shows the apparatus seen in a view from the side but from another direction than in FIG. 1 i.e. from behind.) Thus, according to FIG. 2, it is shown that the downstream pipe 2B has a diameter (d2) which is approximately twice as large as the inside diameter (d1) of the through-flow channel 9. This implies, in the example given, that the diameter of the through-flow channel is 100 mm and that the downstream pipe has a diameter of 200 mm.

As is also seen in FIG. 2, the holes/slits 28 are positioned near the rear end of the through-flow channel 9. With the aim of eliminating the need for an excess amount of material between the inner side of flange the 13 and the pipe body 10, a ring-shaped connection piece 7 is located at the rear end of the pipe body and is arranged to fit closely to both the pipe body 10 and the flange 13, suitably by means of welding. In FIG. 2, it can be seen that the distance (d3) from the front edge of the slits 28 to the rear edge of the through-flow channel 9 is less than the diameter (d1), i.e. less than 100 mm. Due to the sudden increase in area immediately after the thought-flow channel 9, turbulence is created which leads to additional admixing of the added steam, thereby ensuring that an even distribution of the heat supplied to the pulp is obtained in the downstream pipe 2B.

The sudden increase in area is effected preferably in a single stage, as shown in FIG. 2. If desired, the increase in area can be effected in successive stages, but it is essential that the increase in area takes place within a length which is well below the diameter of the pipe 10. The sudden increase in area acts as a retardation zone for the pulp flow, in which zone there is time for the distribution of the steam into the pulp to take place, and the turbulence created ensures good admixing.

The steam, which is introduced to the pulp, penetrates into the pulp in the form of narrow, high-speed jets, which jets are diverted by the pulp flow. By means of the sudden increase in area, the probability of the steam reaching the wall of the channel 2B is reduced, which would otherwise result in rapid cooling and impingement, which impingement would create noise.

The combination of the distribution of the holes 28 close to the rear edge 7 of the through-flow channel 9, and that the increase in area is effected in only one stage and by at least 50% of the area of the through-flow channel, prevents the generation of noise, created by the impact of steam against the walls of the channel in an effective way.

At the same time, good and even admixing of the steam into the pulp flow is obtained.

As shown in FIG. 1, the downstream pipe 2B is a separate unit in relation to the apparatus 1 and thus forms the pipe to the next apparatus in the process sequence. However, it is feasible for this turbulence zone to consist of a separate, delimited pipe section, or a unit integrated with the apparatus, which unit can advantageously be adapted so that it can be connected to any desired downstream pipe, which pipe generally has the same diameter as the inlet pipe 2A.

It should be noted that the invention can be varied within the scope defined by the following patent claims. It has already been mentioned that the fluids which are to be admixed can be fluids other than steam and a pulp suspension, whereby, in general, properties other than temperature are to be controlled by means of regulating the admixing conditions of the first fluid into the second fluid. An example could be the admixing of chemicals into the pulp flow. Further, it is obvious that devices other than a pneumatic piston cylinder can be used for displacing the screen 32, such as, for example, a hydraulic piston cylinder or an electrical motor cooperating with a control device etc. Further, other forms of motion for the movement of the screen other than purely axial, e.g. helical, can be envisaged. An additional modification concerns the orientation of the apparatus 1. In the example shown, the second medium, the pulp suspension, flows from right to left in FIG. 1 and FIG. 3. However, the apparatus can be used in the opposite direction, so that the screen 32 in its completely open position is located upstream of the holes 31 and 28*a–g*. In this case, if the screen 32 is displaced from its completely open position to a position where one series of holes is only partly covered, so that the stream of the first fluid through the holes in this series of holes is throttled, this could result in the fluid flowing through these holes giving a reduced penetration depth into the second fluid, the effect of the flow in the following downstream orientated holes is eliminated.

Those skilled in the art understand also that the pipe-shaped body and pipes can have other cross sections than the purely circular cylindrical shown above, for example rectangular. Further, it is understood that there is the possibility of using more than one connection for introduction of the fluid. In addition, it is understood that, instead of slits as shown above, circular holes can be used. Similarly, it is understood that the orientation of the slits can be altered to positions other than what is shown in FIG. 2. Moreover, it is understood that more than one row of slits can be arranged.

What is claimed is:

1. A method for introducing steam into a pulp suspension, comprising:

providing an apparatus having a steam supply pipe connected to the apparatus, the apparatus having an upstream pipe-shaped body having a substantially circular flow channel defined therein, the upstream pipe-shaped body having a side wall with a first substantially constant diameter (d1), the side wall having an opening defined therein, a downstream pipe-shaped body attached to the upstream pipe-shaped body at a flange, the downstream pipe-shaped body having a second diameter (d2), the second diameter (d2) being at least 50% greater than the first diameter (d1) adjacent to the opening, the second pipe-shaped body having a retardation zone adjacent to the flange;

feeding a pulp suspension in a pulp flow direction of the flow channel, subjecting the pulp suspension to a first pressure and the steam to a second pressure, the second pressure being greater than the first pressure;

feeding the steam in the steam supply pipe; feeding the steam from the steam supply pipe through the opening of the side wall into the pulp suspension flowing in the pulp flow direction in the flow channel;

injecting the steam through the opening into the pulp suspension flowing in the flow channel to form a first mixture of pulp and steam, the opening being located at a distance (d3) from the flange, the distance (d3) being less than the diameter (d1) of the upstream pipe-shaped body; and creating a turbulence of the first mixture adjacent to the opening in the retardation zone defined in the downstream pipe-shaped body whereby the pulp suspension is heated by the steam, the steam being uniformly mixed into the pulp suspension by injecting the steam into the pulp suspension and subsequently mixing the steam and the pulp suspension in the retardation zone.

2. The method according to claim 1 wherein the method further comprises providing the upstream pipe-shaped body with a plurality of slits.

3. The method according claim 1 wherein the method further comprises providing the apparatus with a movable screen that covers the opening.

4. The method according to claim 3 wherein the method further comprises moving the screen to expose the opening.

5. The method according to claim 3 wherein the method further comprises moving the screen with a rod protruding from the apparatus.

6. The method according to claim 1 wherein the method further comprises controlling a temperature of the mixture by opening and closing the opening.

7. The method according to claim 1 wherein the method further comprises providing the steam with a pressure that is greater than a pressure of the pulp suspension.

* * * * *